United States Patent [19]

Kime

[11] 4,278,050

[45] Jul. 14, 1981

[54] RAPID RESPONSE STEAM GENERATING APPARATUS

[76] Inventor: Wellesley R. Kime, 8745 Appian Way, Los Angeles, Calif. 90046

[21] Appl. No.: 100,393

[22] Filed: Dec. 5, 1979

Related U.S. Application Data

[63] Continuation-in-part of Ser. No. 32,935, Apr. 24, 1979, Ser. No. 50,820, Jun. 21, 1979, Ser. No. 52,779, Jun. 28, 1979.

[51] Int. Cl.[3] ..... F22B 27/00

[52] U.S. Cl. ..... 122/39; 122/40; 122/183; 122/460

[58] Field of Search ..... 122/39, 40, 460, 476, 122/467, 468, 459, 479 R, 482, 487, 131, 134, 48, 155 A, 166 R, 183, 348

[56] References Cited

U.S. PATENT DOCUMENTS

| | | | |
|---|---|---|---|
| 1,090,779 | 3/1914 | Dailey | 122/158 |
| 1,527,740 | 2/1925 | Lipshitz | 122/39 |
| 1,616,143 | 2/1927 | Schnepp | 122/183 |
| 1,706,360 | 3/1929 | Newhouse | 122/479 A |
| 1,802,578 | 4/1931 | Schnepp | 122/183 |
| 1,806,216 | 5/1931 | Plummer | 122/39 |
| 2,033,185 | 3/1936 | Dodd | 122/459 |
| 2,790,428 | 4/1957 | Buttler | 122/134 |
| 3,607,117 | 9/1971 | Shaw | 236/15 E |
| 3,636,929 | 1/1972 | Sanders | 122/460 |
| 3,723,047 | 3/1973 | Bandelet de Livois | 431/76 |

*Primary Examiner*—Henry C. Yuen

[57] ABSTRACT

Steam is generated by moving liquid into contact with a (pre-heated) heat retaining substance, typically metal. The heat retaining subtance is maintained at essentially a predetermined temperature by a heat responsive switch that electrically commences and terminates the combustion of fuel for heating the heat retaining substance. Fluid is moved into contact with the heat retaining substance in response to pressure changes in the apparatus so that the pressure within the apparatus is maintained at essentially a predetermined pressure. Superheated gas (steam) may or may not be formed in the process. An expanded surface area for heating the heat retaining substance is provided; an expanded surface area for heating fluid by the heat retaining substance is provided; and an expanded surface area for heating liquid by superheated gas, if present, is provided for generation of steam. Typically an annular combustion chamber is provided and alternate fuels may be used including liquid fuel, gaseous fuel, and/or powdered solid fuel which is mixed with a gaseous substance (air or concentrated nitrogen) and injected into the combustion chamber. Combustion may take place in the presence of air or concentrated oxygen. A molecular air separator may be used for providing concentrated oxygen and/or concentrated nitrogen.

22 Claims, 20 Drawing Figures

RAPID RESPONSE STEAM GENERATING APPARATUS

CROSS-REFERENCE TO RELATED PATENT APPLICATIONS

This application is a continuation-in-part of the following co-pending applications:

Rapid Response Steam Generator, Ser. No. 032,935, filed Apr. 24, 1979, Group number 344.

Rapid Response Steam Generator II, Ser. No. 06/050,820, filed June 21, 1979, Group Art Number 344.

Rapid Response Steam Generator III, Ser. No. 06/052,779 filed June 28, 1979, Group number 344.

BACKGROUND OF THE INVENTION

As the global supply of fossil fuels diminishes, the need for non-conventional apparatuses and methods for utilizing alternate fuels increases.

The apparatus and method herein disclosed provides a means for utilization of liquid fuel(s) and/or gaseous fuel(s) and/or pulverized solid fuels for the rapid generation of steam pressure for use in powering any suitable steam operated device as for example a pressure motor of the type suitable for use in mobile equipment or vehicles.

DEFINITION OF TERMS

As used in this description and in the appended claims, the following terms have the meanings set forth below:

| TERM | MEANING |
|---|---|
| fluid container | fluid storage container |
| fluid | liquid and/or gas (including droplets) |
| steam | vapor produced by bringing any liquid used in the apparatus above the boiling point, the term is used synonymously with vapor |
| gas | the term includes steam and superheated steam if applicable |
| superheated gas | any gas within the apparatus which is superheated, including steam |
| superheated | heated significantly above the boiling point of the liquid at the pressure within the apparatus |
| absorptive | absorbs liquid within the substance |
| adsorptive | retains a film of liquid on the outside of the substance |
| gaseous substance | the gas used for mixing with and injecting the fuel particles into the combustion chamber which may be oxygen or concentrated nitrogen |
| oxygen | a gas containing oxygen, as for example air or concentrated oxygen |
| concentrated oxygen | a gas containing oxygen in a higher percentage than air |
| concentrated nitrogen | a gas containing nitrogen in a higher percentage than in air |
| arcing, arcs | forming an arc or part of a circle |

SUMMARY OF THE INVENTION

Accordingly, the object of the invention is to provide a novel apparatus for rapid commencement and termination of steam generation. An object is to generate steam without waiting for metal to be heated to transfer heat to a liquid before steam generation can commence. To accomplish this goal, fluid is moved into contact with a preheated substance.

An object of the invention is to provide a means for utilizing alternate fuels including solid fuel particles for the generation of steam.

Another object of the invention is to provide a steam generator having a heat retaining substance (maintained essentially at a predetermined temperature) as an instantaneously available source for heat energy to vaporize liquid. A further object of the invention is to control the movement of fluid which comes in contact with the heat retaining substance for maintaining the pressure within the apparatus at essentially a predetermined pressure. As the pressure within the apparatus decreases, an increased volume flow of fluid is moved into contact with the heat retaining substance and vice versa. When the pressure within the apparatus has reached a predetermined operating pressure, the movement of fluid in contact with the heat retaining substance is terminated.

Superheated steam may or may not be generated within the apparatus. If superheated steam is generated, an object of the invention is to utilize excess heat energy in superheated steam for the production of additional steam.

Yet another object of the invention is to provide a relatively large surface area for exposure of fluid with the heat retaining substance within a relatively small apparatus.

A still further object of the invention is to provide a relatively large surface area of exposure of superheated steam, if any, with liquid to be vaporized by excess heat energy in the superheated steam within a relatively small apparatus.

Another object of the invention is to provide optional means for increasing fuel efficiency by optionally providing means for burning fuel with concentrated oxygen.

A further object of the invention is to retain liquid within the apparatus as an available source of liquid to be moved into contact with the heat retaining substance. Additionally, an object of the invention is to maintain the liquid in a reservoir within the apparatus at essentially a predetermined level.

Also, the object of the invention is to provide a rapid response steam generator of the character described which is easy to operate, economical to manufacture, and simple as regards its construction.

Further objects, features and advantages will become apparent to those skilled in the art from the following description when taken into connection with the attached drawings, in which:

DESCRIPTION OF THE PREFERRED EMBODIMENT

Figure 1:
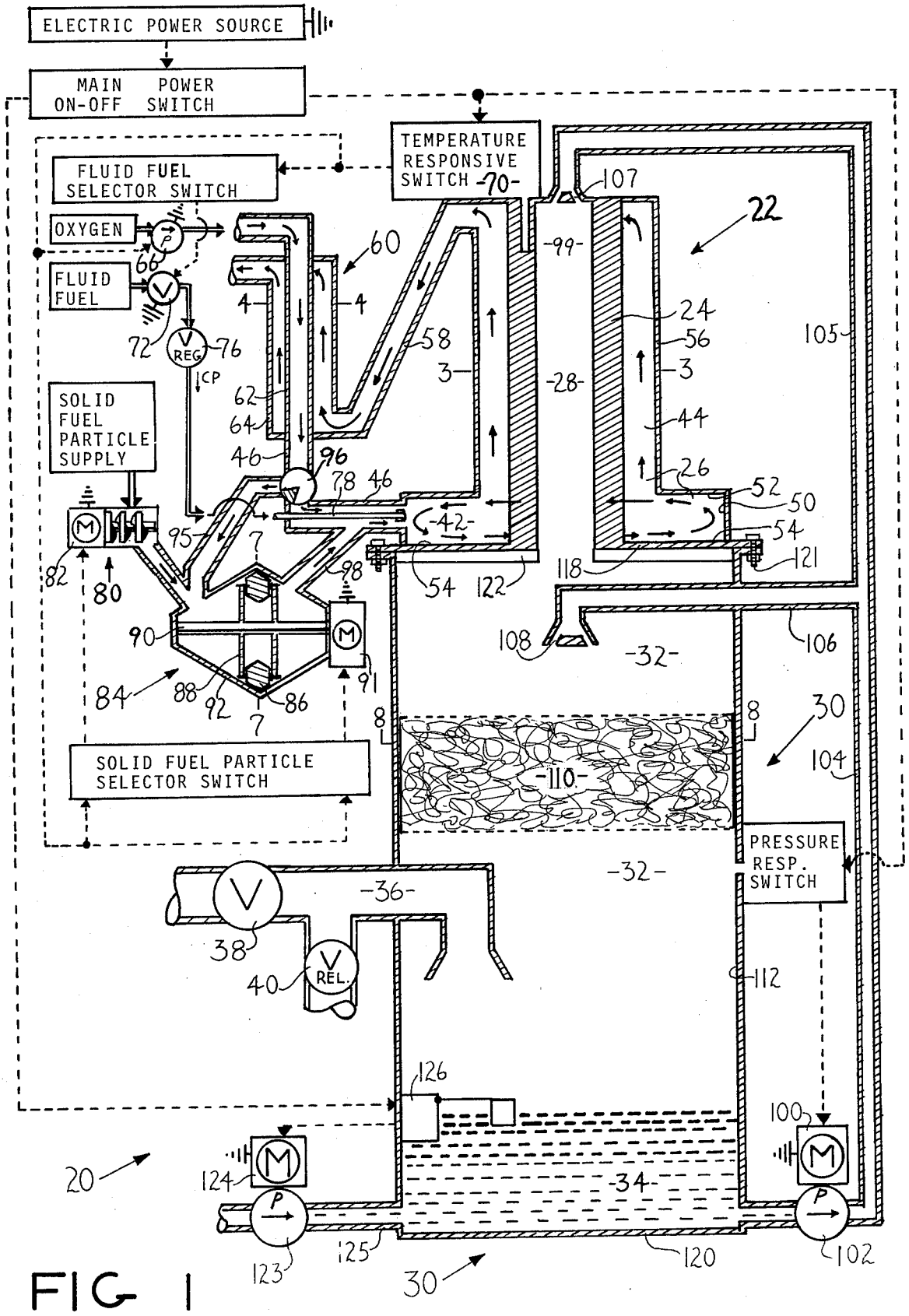
FIG. 1, is a block diagram and diagramatic representation of a section of an apparatus for carrying out the invention.

Referring to the drawings in which like reference numerals index like parts, there is shown a rapid response steam generator indexed generally by the numeral 20, comprised essentially of a heat exchanger 22, having a heat retaining substance 24, a heating assembly 26 for heating the heat retaining substance, a fluid heating passage 28, wherein fluid is brought into contact with the heat retaining substance and heat is transferred from the heat retaining substance to the fluid; a fluid container 30 defining an interior space having an upper portion 32 for retaining steam and a lower portion 34 for retaining liquid (liquid reservoir); and comprising a steam pressure discharge passage 36 having valve 38 (typically of the variable flow type), and optionally having pressure relief valve 40 as a safety precaution for the release of excessive steam pressure.

The apparatus and method also provides for maintaining the heat retaining substance at essentially a predetermined temperature by commencing the burning of fuel when the temperature of the heat retaining substance falls below a predetermined temperature and terminating the burning of fuel when the temperature of the heat retaining substance rises above a predetermined temperature. (The temperature of various portions of the heat retaining substance will vary and any desired location in the heat retaining substance may be used as a reference location for maintaining a predetermined temperature.)

The apparatus and method additionally provides for movement of fluid for contact of the fluid with heat retaining substance when the pressure within the apparatus falls below a predetermined pressure.

Turning to FIG. 1, there is shown a block diagram and sectional view of a diagramatic representation of a preferred embodiment of an apparatus for carrying out the invention. In this figure, heating assembly 26 comprises annular combustion chamber 42 and heat transfer passage 44.

Figure 2:
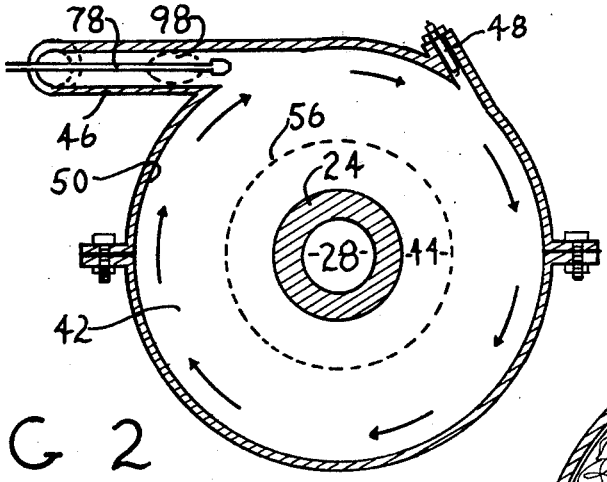
FIG. 2, is a cross section of a typical annular combustion chamber typically used with the apparatus.

Fuel and oxygen are injected into the annular combustion chamber 42 via an eccentric inlet passage 46, FIGS. 1 and 2, so that the mixture arcs (and/or circles) in the peripheral annular portion of the combustion chamber and is ignited by ignition device 48, FIG. 2, which in this instance is shown as a spark plug although any suitable type of fuel ignition device may be used as for example a "fuel ignitor." The interior surface of the peripheral annular wall 50 and the end walls 52 and 54 of the combustion chamber are typically lined with heat (and oxidation) refractory material (not shown in FIGS. 1 and 2) to protect the walls of the combustion chamber from deleterious effects of the intense heat and potential oxidating properties of the arcing (and/or circling) burning fuel. Additionally the apparatus is typically covered with a layer of heat and cold insulating material (not shown in FIGS. 1 and 2) for preventing loss of heat to the atmosphere.

Figure 3:
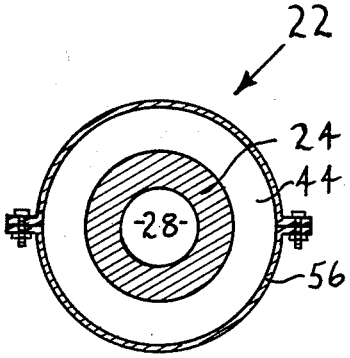
FIG. 3, is a cross section of a typical heat exchanger at the level of the heat transfer passage as for example at line 3—3 of FIG. 1.
Figure 4:
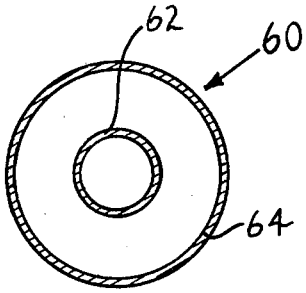
FIG. 4, is a cross section of a second heat exchanger for pre-heating air and/or gaseous substance which is to be injected into the combustion chamber.
Figure 5:
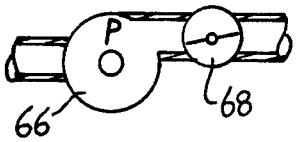
FIG. 5, shows a centrifugal blower and throttle type valve typically used for providing a gas, as for example air, with suitable velocity for injection into an annular combustion chamber.

Products of combustion within the combustion chamber move inwardly with respect to the arcing (and/or circling) burning fuel, forming exhaust which moves upwardly and is discharged from the combustion chamber into heat transfer passage 44. Heat in exhaust is transferred to heat retaining substance 24. The heat retaining substance 24, FIG. 3, is shown to be of annular geometry, as is the outer confining wall 56 of the heat transfer passage 44. Exhaust is discharged from the upper end of the heat exchanger to exhaust outlet tube 58 defining a passage therein for the flow of exhaust typically to a second heat exchanger indexed generally by the numeral 60, FIGS. 1 and 4, wherein usable heat is extracted from the exhaust and transferred to a gas to be injected into the combustion chamber. In this instance the gas is oxygen. Typically the second heat exchanger is tubular in geometry, having an inner passage defined by tubular wall 62 and an outer passage defined by tubular wall 64. In this instance the exhaust flows in the outer passage (in the opposite direction as oxygen which flows in the inner passage.) The source of oxygen flowing through the inner passage may be air or may be concentrated oxygen from a molecular air separator and the oxygen may be drawn through a pump, typically centrifugal pump 66, FIG. 5, to increase the velocity of the oxygen. A valve, as for example a throttle type valve 68, FIG. 5, may be used to regulate the volume flow of oxygen entering the combustion chamber. By pre-heating the gas to be injected into the combustion chamber, less fuel is required to maintain the heat retaining substance within the heat exchanger at essentially the predetermined temperature, and additionally solid fuel particles (heated and dried by the heated gas) are more easily reduced in size and more easily ignited.

Figure 6:
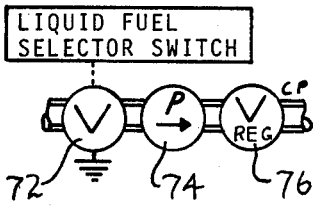
FIG. 6, shows the combination of a liquid selector valve, fuel pump and constant pressure outlet valve which are typically used for providing fluid fuel at a constant pressure for injection into the combustion chamber.

The electrical power source shown in FIG. 1 is typically a storage battery which is coupled to the main power on-off switch, the latter typically being electrically coupled to the temperature responsive switch 70 which in this instance senses the temperature in the upper end of the heat retaining substance (the annular combustion chamber being on the opposite end of the heat retaining substance). When the temperature of the heat retaining substance at the location of the temperature responsive switch is below a predetermined temperature, electricity flows through the temperature responsive switch to the fuel selector switches for fluid fuel and solid fuel particles. Although only one fluid fuel selector switch is shown for simplicity, typically at least two fluid fuel selector switches are provided for selection of either liquid and/or gaseous fuels. Depending on the fluid fuel selected, electricity flows to fluid fuel on-off valve 72 (for liquid fuel or for gaseous fuel). Fuel pump 74, FIG. 6, is provided to increase the pressure of a liquid fuel, and pressure regulator (constant pressure outlet valve) 76, FIG. 6, is optionally provided for providing the fluid fuel at a predetermined pressure. In this instance the fluid fuel inlet tube 78 passes through eccentric gaseous inlet tube 46. Liquid fuel is typically discharged through a spray nozzle at the end of the gaseous inlet passage 46 to facilitate mixing of fuel and oxygen.

Figure 7:
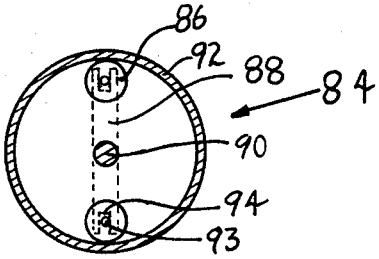
FIG. 7, is a cross section of a solid fuel particle size reducer, taken through line 7—7 of FIG. 1.

When the solid fuel particle selector switch is turned "on", and the temperature of the heat retaining substance 24 is below a predetermined temperature, electricity flows through the temperature responsive switch to an actuator for solid fuel feed assembly indexed generally by numeral 80; in this instance the actuator is motor 82 and the solid fuel feed assembly is a worm screw mechanism, although any suitable type of feed assembly may be used. If the solid fuel particles are sufficiently small in size, they may be injected directly into the combustion chamber with the flow of oxygen. Or, any suitable means for reducing the particle size may be used. In this instance the fuel particles are fed into a particle size reducer indexed generally by the numeral 84, which is of the type utilizing rotating rollers 86 to crush the particles and thereby reduce the particle size. In this instance rollers 86 are turned by arms 88 which are attached to shaft 90, the latter being rotated by motor 91. The fuel particles are crushed between rotating rollers 86 and symmetrical housing 92, FIGS. 1 and 7. The rotating rollers are typically urged outwardly by centrifugal force generated by the rapid rotation thereof, the central pin 93 of the rotating rollers (which may or may not be provided with bearings) may move somewhat inwardly or outwardly in groove 94 defined by arm 88, FIG. 7.

A pump, not shown, may also be used if needed to increase the pressure of a gaseous fuel prior to passing the gaseous fuel through constant pressure outlet valve (pressure regulator) 76.

A desired volume flow of oxygen passing through inlet tube 46 is directed into the first communicating tube 95 via valve 96 and then into the particle size reducer 84; the particles fall by gravitation to the lowest portion of the particle size reducer where they are crushed as above described. The fine particles thus formed are mixed with oxygen by the whirling action of rollers 86 in the particle size reducer and flow with the oxygen through the second communicating tube 98 and into the oxygen inlet tube 46; the mixture is injected into the combustion chamber so as to arc (and/or circle) in the peripheral portion of the combustion chamber. The fuel particle and oxygen mixture is ignited by fuel ignition device 48.

When the pressure within the apparatus is below a predetermined pressure, fluid is moved from the fluid reservoir 34 to the upper portion 99 of fluid heating passage 28. In this instance, the pressure responsive switch is electrically coupled with the main power on-off switch, so that when the pressure in the fluid container 30 is below a predetermined pressure, electricity flows to motor 100 which powers pump 102 (typically a rotary pump, but any suitable type of pump may be used) to move liquid through common liquid tube 104, primary liquid tube 105 and secondary liquid tube 106. Said tubes 105 and 106 may have adjustable flow restrictor valves for regulating the ratio of flow through said tubes. Liquid in the primary liquid tube 105 is sprayed into the upper portion of the liquid heating passage 28 via primary spray head 107 which may be of any suitable type, and liquid in the secondary liquid passage 106 is discharged in the upper portion of fluid container 30 via secondary spray head 108 which is of any suitable type.

When the liquid sprayed into the liquid heating passage 28 is not completely vaporized, the excess liquid falls into fluid container 30 and is retained in the liquid reservoir 34. When the liquid sprayed into the liquid heating passage 28 is completely vaporized and superheated, the superheated steam thus formed comes in contact with fluid droplets sprayed into the upper portion of fluid container 30 and is retained in liquid reservoir 34.

When the liquid sprayed into the fluid heating passage 28 is completely vaporized and superheated, the superheated steam thus formed comes in contact with fluid droplets sprayed into the upper portion of the fluid container by the secondary spray head 108. The liquid, as a spray, has a large surface area for contact with superheated steam and excess heat in the superheated steam is transferred to the fluid droplets, heating the droplets and generating additional steam.

The excess droplets fall into the absorptive and/or adsorptive substance 110 which is typically retained in a cartridge. Some of the fluid is retained in the absorptive and/or adsorptive material and the remainder falls to the lower portion of the fluid storage container 30 and is retained in the liquid reservoir 34. The function of the liquid absorptive and/or adsorptive material is (a) to remove the fine droplets from the steam passing through the cartridge of absorptive and/or adsorptive material by forming drops which fall from the cartridge to the liquid reservoir 34, and (b) to provide a large area of contact of liquid with superheated steam which passes through the absorptive and/or adsorptive material or additional steam generation.

Figure 8:
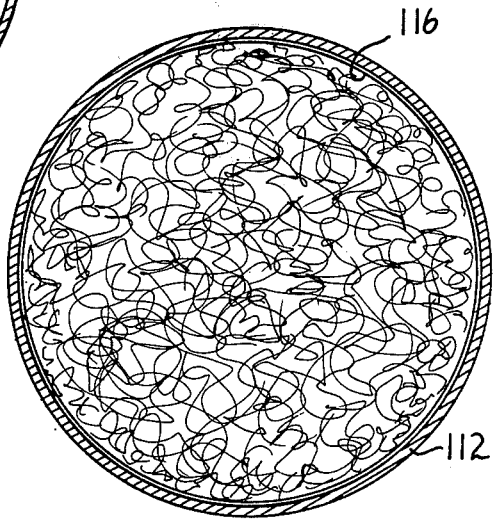
FIG. 8, is a cross section of FIG. 1, taken through line 8—8, showing the cartridge containing filamentous absorptive and/or adsorptive material.

Typically the fluid container 30 is of annular peripheral geometry as shown by annular wall 112 in FIG. 8. The peripheral wall 116 of cartridge containing absorptive and/or adsorptive material conforms in peripheral geometry with wall 112 and is in space relation with said wall so that fluid above the cartridge passes through the cartridge to reach a position below the cartridge.

Typically the apparatus is comprised of an upper portion which includes the heat exchanger and the top end of the fluid container and a lower portion which includes the annular peripheral wall 112 and end wall 120 of the fluid container and the two sections are typically bolted together at their respective flanges by bolts 121.

In FIG. 1, the end wall 54 of the combustion chamber is comprised of a portion of end wall 118 of the fluid container 30. A layer of heat and cold insulation 122 is typically provided to prevent transfer of heat directly from the combustion chamber to the upper portion 32 of fluid container 30.

The absorptive and/or adsorptive material 110 shown in FIG. 1 is of a filamentous nature and may be comprised of any suitable substance, as for example fiberglas, stainless steel, hemp or cotton fiber.

Pump 123 powered by motor 124 forces replacement liquid through tube 125 into the liquid reservoir 34. Motor 124 is electrically coupled with float valve 126, the latter being electrically coupled with the main power on-off switch so that when the level of liquid in liquid reservoir 34 is below a predetermined level, motor 124 is activated to power pump 123 to force additional replacement liquid into the liquid reservoir. An optional check valve, not shown, may be used to prevent the backflow of liquid into tube 125 when pump 123 is not in operation.

Figure 9:
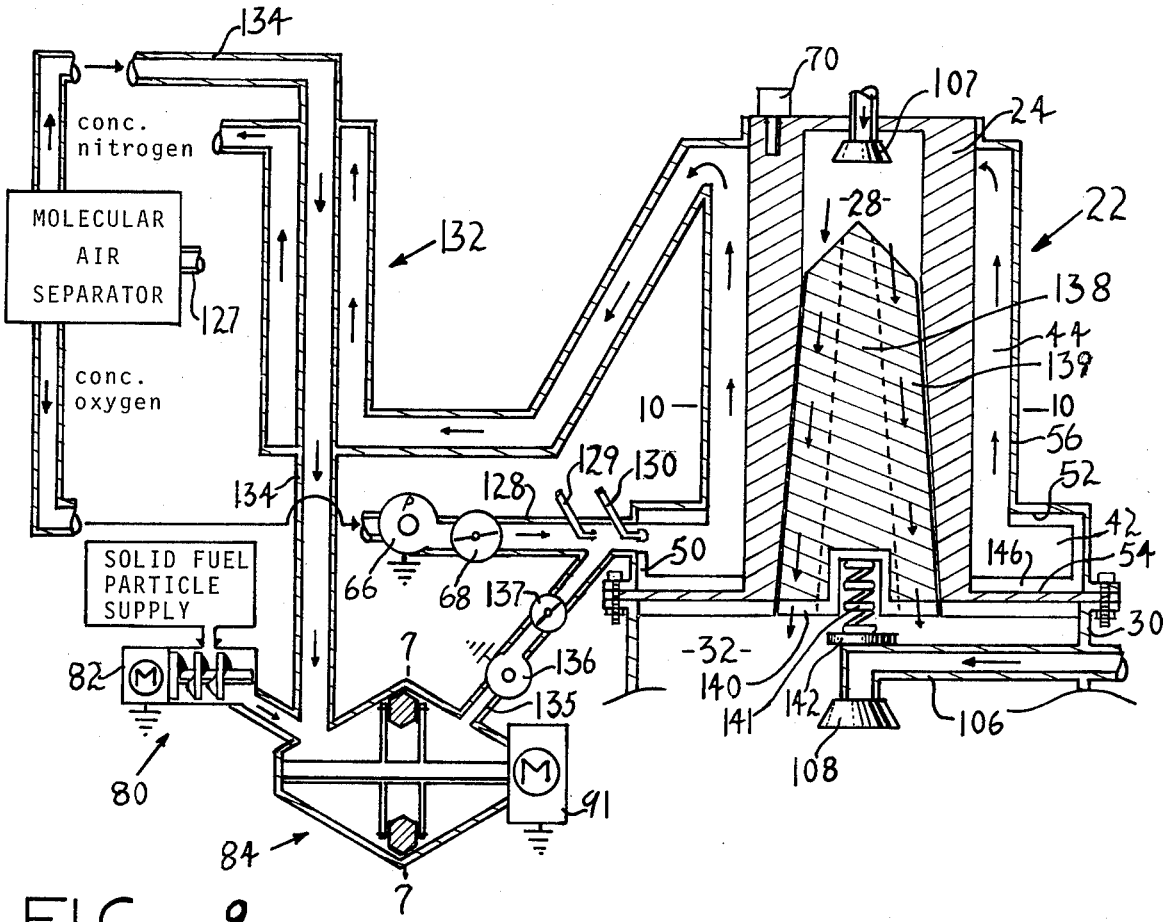
FIG. 9, is a block diagram and diagramatic representation showing a molecular air separator providing concentrated oxygen and concentrated nitrogen for use with the apparatus; and also shows the heat exchanger having an obturator which is provided with longitudinal grooves.
Figure 10:
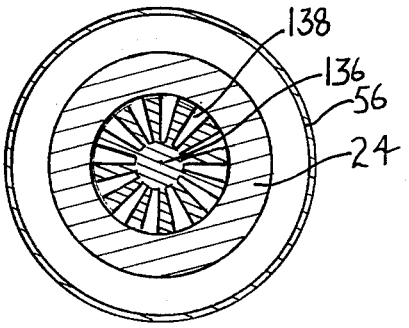
FIG. 10, is a cross section of FIG. 9 at 10—10.

Turning to FIG. 9, there is shown a molecular air separator (block diagram) as a source for concentrated oxygen and concentrated nitrogen to be used in the apparatus. Air enters the molecular air separator through inlet passage 127; the air is separated into its major constituents, concentrated oxygen and concentrated nitrogen. Concentrated oxygen is seen to pass through eccentric oxygen inlet tube 128 and into annular combustion chamber 42 which is similar to the combustion chamber in FIG. 1 and 2. Eccentric oxygen inlet 128, FIG. 9, is shown to have separate gaseous fuel inlet 129 and liquid fuel inlet 130. Pump 66 and valve 68 may optionally be used for providing velocity and regulating the volume flow of the oxygen for injection into the combustion chamber. Excess oxygen provided by the molecular air separator, if any, may be discharged to the atmosphere (via outlet not shown). Concentrated nitrogen from the molecular air separator is shown to pass through second heat exchanger 132 (which is similar to second heat exchanger 60, FIG. 1, except that concentrated nitrogen rather than oxygen is heated by the heat exchanger) via nitrogen tube 134 and into particle size reducer 84. A mixture of fuel particles and nitrogen flows through communicating tube 135, being moved by pump 136 and the volume flow being regulated by throttle type valve 137. The ratio of nitrogen to oxygen is regulated by adjusting valves 137 and 68. As apparent to one skilled in the art, a fuel mixture containing a higher oxygen to nitrogen ratio will generate more heat energy.

Motor 82 which powers the solid fuel feed assembly 80, typically of a constant speed variety, is run at a constant speed, but is adjustable as an alternate means of providing the desired fuel to oxygen ratio.

In FIG. 9, the interior surface of heat retaining substance 24 is tapered outwardly toward the fluid container (which is only partly shown in this figure). Liquid heating passage 28 is provided with obturator 138, having grooves 139 through which the fluid passes. The purpose of the obturator is to direct the fluid through the grooves; the obturator and walls defining the grooves are heated by conduction of heat from the heat retaining substance 24. As shown, the peripheral annular wall of the obturator corresponds in geometry with the interior surface of the heat retaining substance 24, and typically is in space relation with said interior surface. The undersurface of the obturator typically is provided with a layer of heat and cold insulating material 140, composed of any suitable material, for preventing the transfer of heat directly into the upper portion 32 of the fluid container. Said heat and cold insulating material contains grooves conforming with grooves in the obturator for passage of fluid.

Obturator 138 is urged upwardly into the fluid heating passage 28 by any suitable biasing means, as for example spring 141 which is supported inferiorly by disc 142, the latter being secured to the upper surface of the secondary liquid tube 106.

In the event of excessive pressure build-up in the fluid heating passage 28 above the obturator, the obturator is momentarily urged downwardly by the excess pressure, thus allowing increased area for the discharge of fluid into the fluid container 30.

Temperature responsive switch 70 is again seen at the top end of the heat exchanger and the combustion chamber 42 is at the lower end of the heat exchanger. A layer of refractory material 146 is seen lining the interior surface of end walls 52 and 54 and the peripheral annular wall 50 of the combustion chamber.

Figure 11:
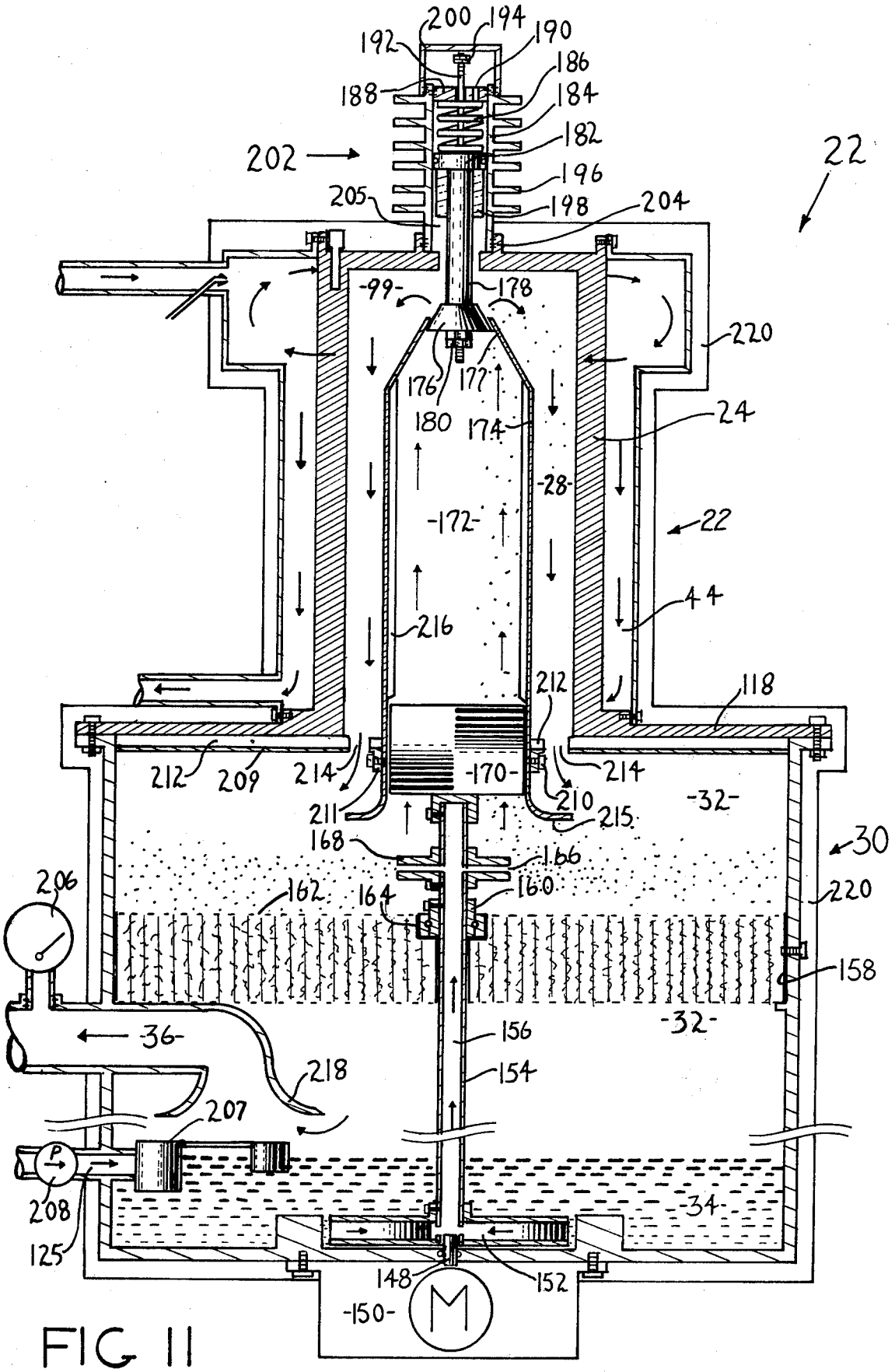
FIG. 11, is a section of an apparatus for carrying out the invention wherein steam (gas) is moved into contact with the heat retaining substance or steam (gas) with droplets of water is moved into contact with the heat retaining substance.

FIG. 11 shows an alternate preferred embodiment of the apparatus for carrying out the invention. Shaft 148 of motor 150 (secured to the bottom end of the apparatus) protrudes through the bottom end of fluid container 30; a pressure seal symbolized by an o-ring is provided. The shaft is secured to centripetal blade 152 by set screw not shown, so that liquid from liquid reservoir 34 is forced upward into passage 156 of tubular shaft 154 when the centripetal blade is rapidly rotated. Tubular shaft 154 passes through cartridge 158 containing absorptive and/or adsorptive material and is supported by ball bearings 160 which are partially recessed in and supported by perforated top end 162 of said cartridge at 164. (Said cartridge is typically made of stainless steel but may be made of any suitable material.) A plurality of small passages 166 defined by spray head 168 communicate with passage 156 defined by tubular shaft 154. Liquid flowing upwardly through passage 156 is discharged into upper end 32 of fluid container 30 via passages 166, forming a spray when spray head 168 is rapidly rotated. Fan blade 170 which is secured to tubular shaft 154 is rotated by said shaft urging vapor upwardly into passage 172 defined by tubular member 174 which communicates upper end 32 of fluid container 30 with upper end 99 of liquid heating passage 28 when valve plate 176 is in the open position. In FIG. 11, the valve plate 176 is in the closed position, as it would be when the pressure within the apparatus has reached a predetermined pressure, then valve plate 176 fits against valve seat 177 formed by the inward tape of the top end of tubular member 174. Valve plate 176 is secured to shaft 178 by lock nuts 180 which are threadably received on threaded lower end of shaft 178. Shaft 178 is moved upwardly or downwardly by piston 182, the o-ring of said piston forming a pressure seal against the inner wall of cylinder body 184. Piston 182 is urged downwardly by spring 186 which rests against threated adjustable end support 188 which may be rotated and moved upwardly or downwardly to adjust the tension on spring 186. Air pressure is equalized in the upper portion of cylinder 184 via aperture 190 defined by threated adjustable end support 188. Upper end 192 of shaft 178 protrudes through adjustable end support 188 so that it can be visually determined if valve plate 176 is in the open or closed position. Additionally, end 192 of shaft 178 is threaded, and lock nuts 194 are provided which provide a means of adjusting the maximum volume flow of fluid through the valve. Cylinder body 184 is provided with cooling fins 196 and shaft 178 is provided with some surrounding heat and cold insulating material 198 of any suitable type to prevent excessive heating of the o-ring on piston 182. Cylinder body 184 is additionally provided with protective end cover 200 to prevent end 192 of shaft 178 from inadvertently being pushed downwardly. End cover 200 contains aperture, not shown, for permitting visibility of end 192 of shaft 178 while end cover 200 is in place, and for allowing equalization of atmospheric pressure within the cover.

In FIG. 11, valve controlling mechanism, indexed generally by numeral 202, is threadably received in the top end of the heat exchanger 22 at 204, forming a pressure seal. When pressure within the fluid heating passage is greater than the downward force exerted on piston 182 by spring 186, vapor passes around shaft 178, and into cylinder 205, moving piston 182, attached shaft 178, and valve plate 176 upward, thus reducing or terminating the flow of vapor through the fluid heating passage.

The particle size of droplets discharged from spray head 168 can be reduced by reducing the size of passage 166 and increasing the rotational speed of motor 150. The left side of FIG. 11 shows droplets falling into the cartridge and vapor only entering passage 172. In this event the vapor is superheated as it passes around the outside of tubular member 174 and comes in contact with heat retaining substance 24. The superheated vapor is discharged into the upper portion 32 of fluid container 30 above the cartridge and releases heat to droplets of liquid and to liqulid retained in the absorptive and adsorptive material in the cartridge thereby generating additional steam.

When droplets released by spray head 168 are of sufficiently small size to form a fog or mist, the droplets fill the upper portion 32 of fluid container 30 above the cartridge, and in addition the droplets move into the path of fan blade 170 then are forced upward and through tubular member 172, through the valve and into contact with heat retaining substance 24, thus generating additional steam when the liquid is vaporized. The generated steam may additionally become superheated with further generation of steam when the superheated steam comes in contact with droplets in the upper portion of fluid container 30 of liquid held by the adsorptive and/or absorptive material in the cartridge.

FIG. 11 shows a pressure gauge 206 provided for determining the pressure within the apparatus and for adjusting valve controlling mechanism 202. The valve controlling mechanism may be adjusted as follows: Introduce a gas under pressure through steam discharge passage 36 until the pressure within the apparatus is at the desired operating pressure. Then, adjust end support 188 by rotating the end support to increase or decrease the tension on spring 186 so that the valve is in the closed position but opens as the pressure in the apparatus is slightly lowered.

In FIG. 11, the liquid is retained at the desired level in the liquid reservoir by float valve 207. Replacement liquid is forced into the apparatus by pump 208 when float valve 207 is "open". Pump 208 in this instance is electrically powered having a pressure responsive switch, not shown, so that the pump "starts and stops" in response to output pressure. Thus, when float valve 207 is in the "closed" position, output liquid pressure from pump 208 increases to the point that the pump "turns itself off." A check valve, not shown, may additionally be provided to prevent the back flow of liquid in tube 125.

Tubular member 174, FIG. 11, is secured to support 209 by screws 210 at flange 211 of suppport 209, said flange being of annular geometry and being located at the edge of an aperture defined by support 209, through which tubular member 174 passes. Support 209 is secured to heat and cold insulating material 212 by any suitable means as for example by an adhesive substance and the heat and cold insulating material is secured to the under surface of the top end 118 of fluid container 30 by any suitable means as for example an adhesive substance. Or, screws, not shown, may be used to secure support 29 (and heat and cold insulating material 212) to the under surface of the top end 118 of fluid container 30. Support 209 and insulating material 212 defined aperture 214 which provide communication between fluid heating passage 28 and top end 32 of the fluid container. The lower end 215 of tubular member 174 is turned outwardly to form a deflector for directing the heated fluid discharged from fluid heating passage 28 outwardly so that the heated fluid will not immediately be drawn by fan blade 170 into passage 172. Tubular member 174 is provided with an inner layer of heat and cold insulating material 216 for tending to prevent the heating of fluid within passage 172.

Steam discharge passage 36 is provided with drip flange 218 so that drops of liquid will tend to fall into the liquid reservoir rather than being sucked into the steam discharge passage when steam is discharged from the apparatus.

Figure 12:
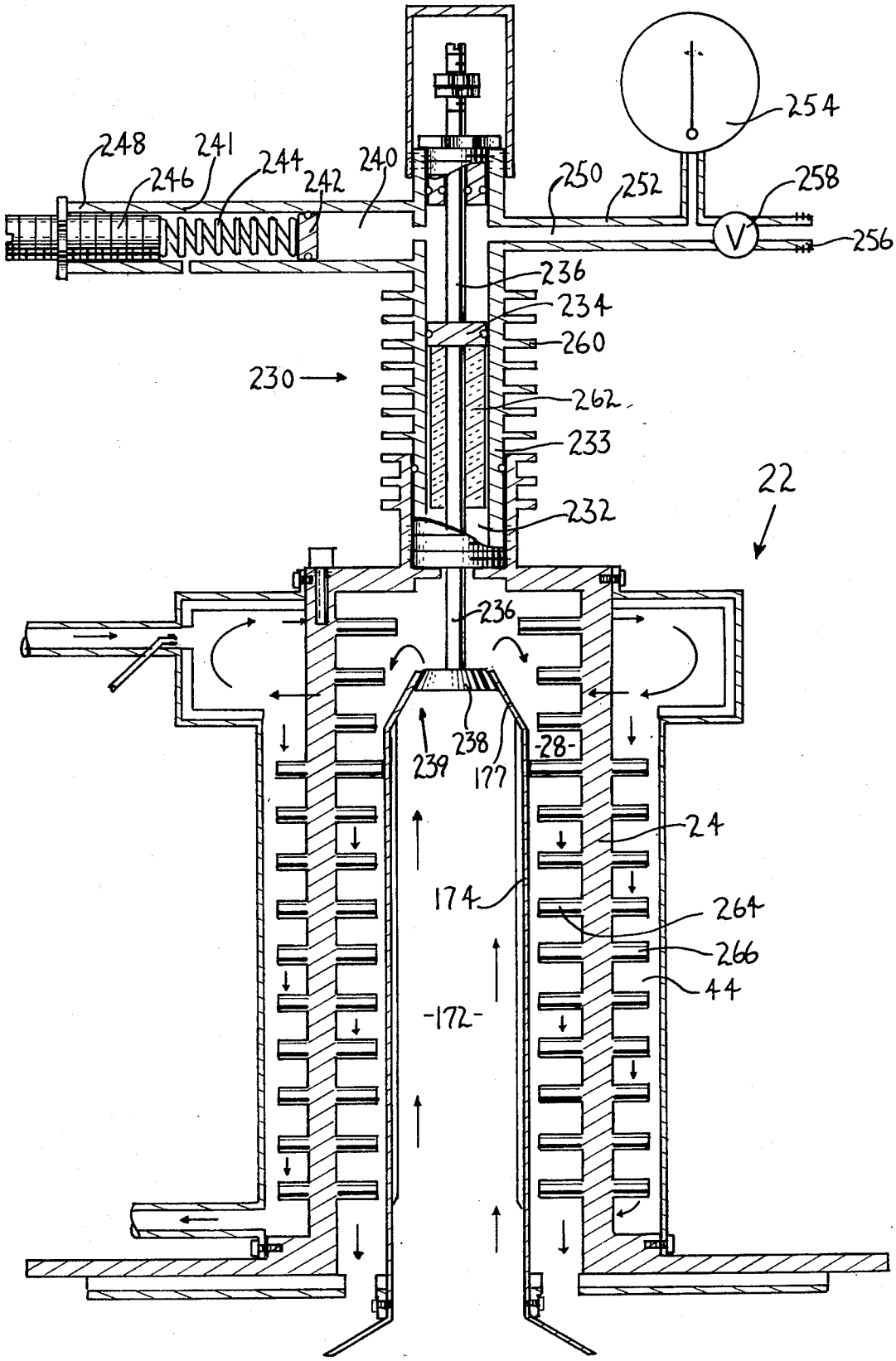
FIG. 12, shows the heat exchanger of FIG. 11 optionally having a hydraulically operated value controlling assembly and shows the heat retaining substance as having inwardly and outwardly directed projections.

In FIG. 12, valve controlling assembly 230 which regulates the flow of vapor through passage 172 defined by tubular member 174, is hydraulically actuated. Steam pressure is exerted upwardly from fluid heating passage 28 to the lower portion of cylinder 232 defined by cylinder body 233, and exerts upward pressure on piston 234 and attached shaft 236 thereby urging valve plate 238, attached to shaft 236, upwardly thus closing valve 239 defined by valve plate 238 and valve seat 177. Hydraulic fluid in cylinder 240 defined by cylinder wall 241 is urged into the upward portion of cylinder 232 by the action of piston 242 which is urged inwardly by spring 244, the latter pushing against turning screw 246 which is threadably received into end 248 of cylinder wall 241. The hydraulic fluid thus urges piston 234 downwardly for opening valve 239. Hydraulic fluid under pressure in the upper portion of cylinder 232 is urged into passage 250 defined by tube 252 which communicates with pressure gauge 254, the latter providing a visual reading of the hydraulic pressure in the upper portion of cylinder 232, so that turning screw 246 may be adjusted for providing the required hydraulic pressure for opening valve 239 when the pressure within the fluid heating pressure 28 falls below a predetermined pressure. Hydraulic fluid may be added or removed from valve controlling assembly 230 via threaded end 256 of tube 252 when valve 258 is "open."

Valve controlling assembly 230, FIG. 12, is provided with cooling fins 260 in cylinder body 233 and heat and cold insulating material 262 of any suitable type surrounding a portion of shaft 236 below piston 234 so that the o-rings and hydraulic fluid in the valve controlling assembly will not become excessively heated.

FIG. 12 also shows heat retaining substance 24 as having inwardly directed projections 264 for increasing the area of surface contact of fluid within fluid heating passage 28 and the heat retaining substance 24; and having outwardly directed projections 266 for increasing the area of surface contact and heat transfer between exhaust in heat transfer passage 44 and heat retaining substance 24.

Figure 13:
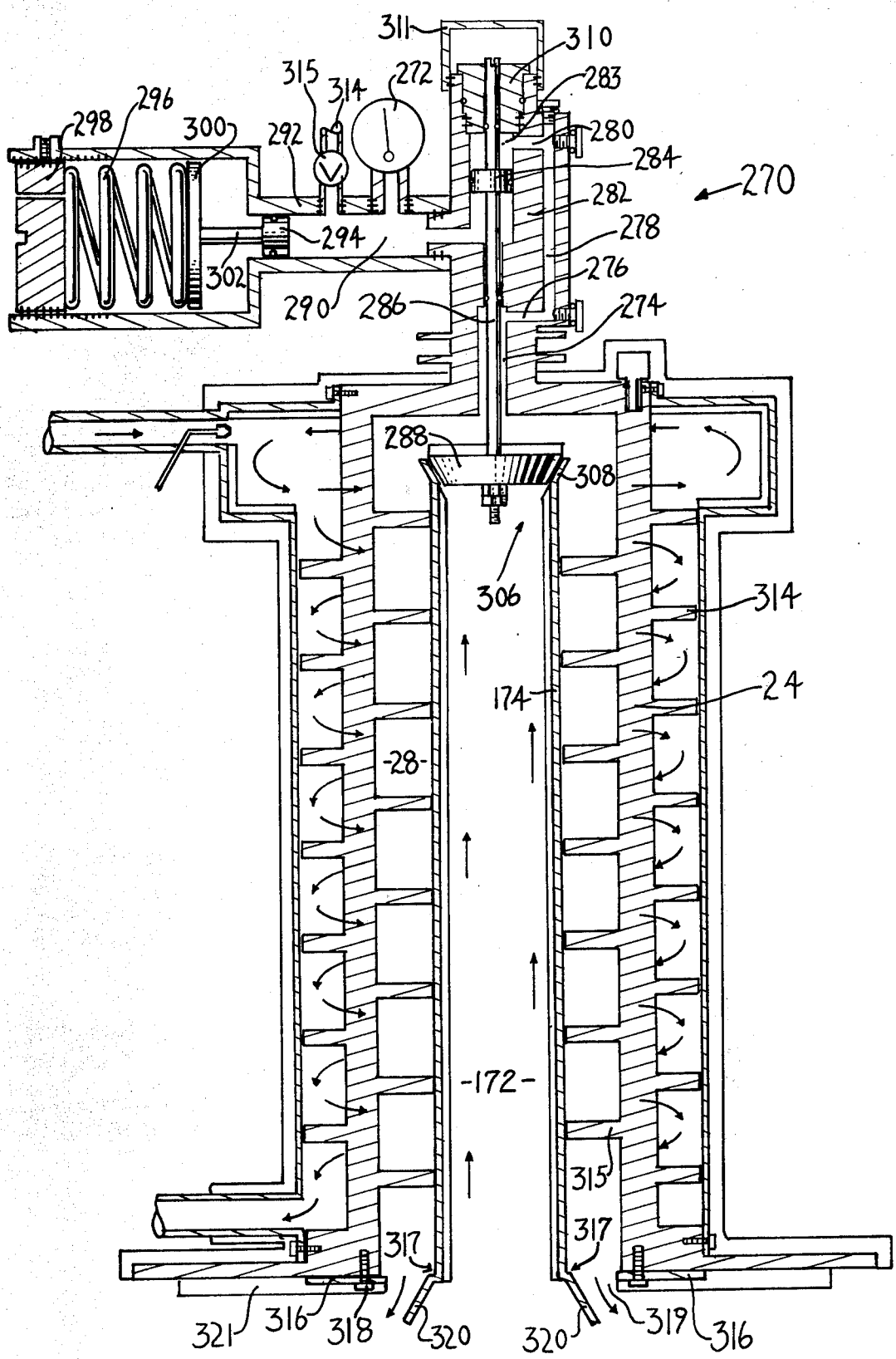
FIG. 13, shows the heat exchanger of FIG. 11 having an alternate hydraulically operated valve controlling assembly and shows the heat retaining substance as having an internal and external helix.

In FIG. 13, valve controlling assembly 270 is hydraulically operated and the pressure of hydraulic fluid can be visually seen by observing gauge 272. Pressure from within fluid heating passage 28 is exerted upwardly through passages 274, 276, 278, and 280 defined by valve body 282, and enters the upper portion of cylinder 283 defined by valve body 282, thereby exerting downward pressure on piston 284 located in cylinder 283. Shaft 286 is attached to piston 284; valve plate 288 is secured to shaft 286 so that valve plate 288 moves upwardly or downwardly as piston 284 moves upwardly or downwardly respectively. Hydraulic fluid in cylinder 290 defined by cylinder wall 292 is under pressure resulting from force exerted via piston 294, the latter being urged forward by spring 296 which rests against adjustable turning screw 298; said spring urges end plate 300 with attached shaft 302 and piston 294 (attached to shaft 302) in a forward direction.

The hydraulic fluid under pressure enters the lower portion of cylinder 283 and urges piston 284 in an upward position for moving shaft 286 and valve plate 288 in an upward position for opening valve 306 defined by valve plate 288 and valve seat 308, the latter being an outwardly directed flange of tubular member 174. The top end of cylinder 283 is sealed by end piece 310 which is threadably received in the top end of valve body 282. Shaft 286 projects through end piece 310 for allowing a visual indication as to whether valve 306 is in the open or closed position. Protective end cover 311, typically having aperture to permit visual inspection of the protruding end of shaft 286, is threadably received on the end of valve body 282.

Hydraulic fluid can be added or removed through tube 314 which is provided with valve 315 for this purpose.

The tension on spring 296 may be adjusted by rotating turning screw 298 so as to move the turning screw inwardly or outwardly. The hydraulic pressure in valve controlling assembly 270 is thus increased or decreased thereby controlling the pressure within fluid heating passage 28 that valve 306 will open or close. FIG. 13 shows spring 296 to be much larger in diameter than piston 294 for providing greater biasing of piston 294 than could be obtained by a spring of essentially the same diameter as piston 294. Turning screw 298 is provided with an air pressure equalization passage as shown and a set screw as shown, the latter being a safety precaution for preventing turning screw 298 from moving out of adjustment.

FIG. 13 additionally shows heat retaining substance 24 as having an external helix 314 for causing the exhaust to spiral the heat retaining substance 24 as shown by arrows for increased heat transfer from the exhaust to the heat retaining substance. Also, the heat retaining substance 24 is provided with an internal helix 315 for causing fluid within heating passage 28 to spiral for increased transfer of heat from the heat retaining substance to the fluid within the fluid heating passage.

FIG. 13 shows annular flanged end 316 of tubular member 174 directed at right angles outwardly at 317. End 316 of tubular member 316 is secured to the heat retaining substance by screws 318. Groove 319 are provided in end 316 of tubular member 174 to permit passage of heated fluid from the fluid heating passage 28 to the upper portion of the fluid container (not shown in this figure). Segmets 320 of end 316 of tubular member 174 are directed downwardly and outwardly as a partial shield for tending to prevent heated fluid passing through grooves 319 from flowing directly into passage 172. End 316 of tubular member 174 is covered by heat and cold resistant material 321, made of any suitable material, for tending to prevent the direct transfer of heat from the heat retaining substance to the upper portion of the fluid container (not shown in this figure).

Figure 14:
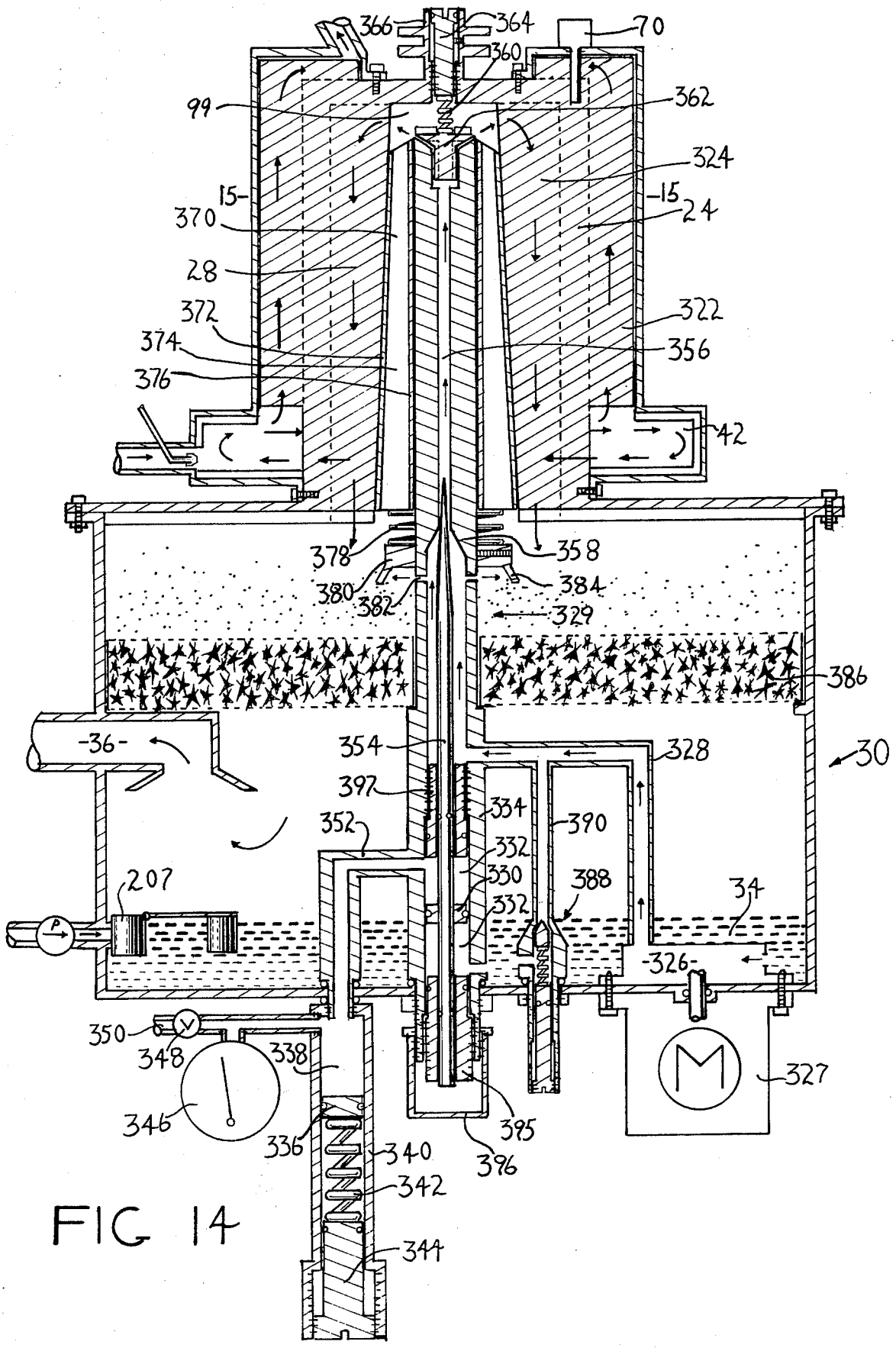
FIG. 14, shows an alternate preferred embodiment of the apparatus wherein fluid is moved into the heat exchanger from within the apparatus and shows the heat retaining substance having internal and external ridges and grooves, and shows the heat exchanger as having an obturator for directing the fluid into the internal grooves.
Figure 15:
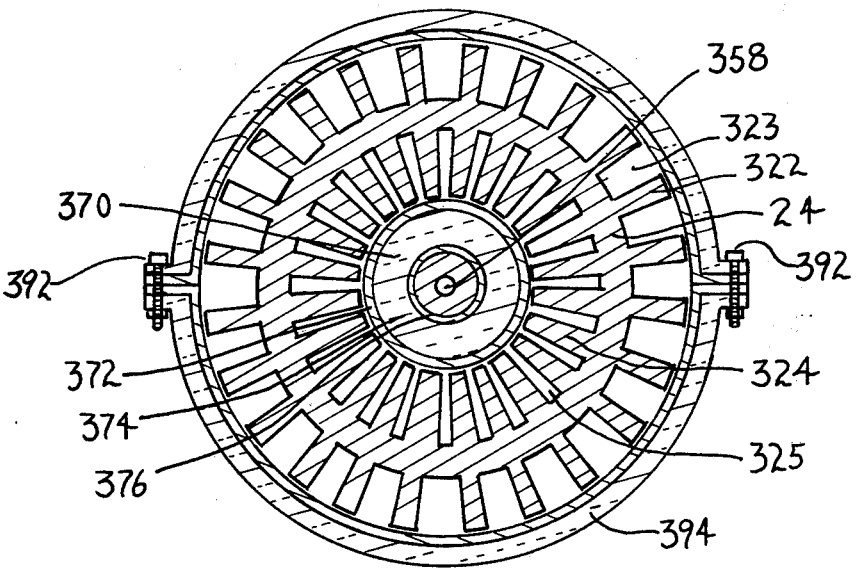
FIG. 15, is a cross section of FIG. 14 at 15—15.

Turning to FIGS. 14 and 15, heat retaining substance 24 is shown to be provided with outwardly projecting ridges 322 forming grooves 323 through which the exhaust passes thereby increasing the surface area for heat transfer from the exhaust to the heat retaining substance. The heat retaining substance is additionally provided with inwardly projecting ridges 324 which form grooves 325 through which fluid passes in the fluid heating passage thereby increasing the surface area for heat transfer from the heat retaining substance to the fluid. In this drawing, liquid is moved from liquid reservoir 34 by pump 326 which is powered by motor 327. The shaft of motor 327 is diagrammatically shown protruding through the bottom end of fluid container 30 and a pressure seal is diagramatically represented by an "o-ring." Liquid moved by pump 326 is moved through tube 328 to needle valve indexed generally by the numeral 329. Liquid in liquid reservoir 34 is exerted upwardly on piston 330 in the lower portion of cylinder 332 defined by body 334 of needle valve 329. Piston 330 is urged downwardly by hydraulic fluid in the upper portion of cylinder 332, the hydraulic fluid being placed under pressure by piston 336 in cylinder 338 defined by cylinder wall 340. Piston 336 is urged inwardly by spring 342, the tension of which may be increased or decreased by adjusting turning screw 344. The hydraulic pressure in the valve controlling mechanism may be determined visually by glancing at gauge 346, for determining the pressure at which needle valve 329 will open or close. Valve 348 is provided in tube 350 for permitting the addition or removal of hydraulic fluid into cylinder 338. Cylinder 338 communicates with cylinder 332 via tube 352. When the pressure in the apparatus exceeds a predetermined pressure, piston 330 of needle valve 329 is urged upwardly, moving attached shaft 354 upwardly and occluding valve passage 356 at taper 358. When the pressure in the apparatus falls below a predetermined pressure, piston 330 and attached shaft 354 are urged to move downwardly thus opening valve passage 356 defined by the upper portion of body 334 of needle valve 329. Any suitable spray head may be used for spraying the fluid evenly in the upper portion 99 of fluid heating passage 28, however in this instance spring 360 urges spray head core 362 downwardly to provide a fine spray. Spray head core 362 is mounted in an enlarged upper portion of passage 356 and fluid passes through ridges in the core to the edge of the outwardly tapered upper end of the core from where the liquid is sprayed. Spring 360 presses against turning screw 364 which is threadably received in tubular upward extension 366 of heat retaining substance 24. Tubular upward extension 366 is provided with cooling fins for preventing excessive heating of the "o-ring" used to provide a pressure seal.

The heat exchanger in FIG. 14 is additionally provided with obturator 370 which directs fluid in the fluid heating passage 28 to flow in grooves 325 of said passage. Obturator 370 is tapered to conform with the taper of ridges 324. In this instance obturator 370 comprises an outer typically metallic layer 372, a middle layer 374 comprising any suitable heat and cold insulating material and an inner typically metallic layer 376. Heat and cold insulating layer 374 is provided for preventing overheating of fluid in passage 356.

Obturator 370, FIGS. 14 and 15, is urged upwardly by spring 378, FIG. 14, which rests on support plate 380, the latter being secured to needle valve 329 by a set screw. The obturator may move downwardly to release excessive pressure generated within the fluid heating passage, and spring 378 will return the obturator back to its original position.

A fine stream of liquid is released from needle valve 329 through openings 382. The steam of liquid strikes the inner surface of fingers 384 which are secured to the lower outer portion of support plate 380, thus converting the fine stream of liquid to a mist or fog. The absorptive and/or adsorptive substance in cartridge 386 in this instance is comprised of essentially star-shaped particles which are made of any suitable substance as for example ceramic composition material. The "points" of the "stars" separate the particles for permitting unobstructed flow of fluid through the cartridge while the particles provide a large area of adsorptive and/or absorptive material. (The ceramic composition material may be porous for retaining liquid.)

An adjustable pressure release valve indexed generally by the numeral 388, FIG. 14, is provided for excess fluid under pressure to be released from tube 328, through tube 390, to return back to the liquid reservoir 34.

FIG. 15 shows the outer confining wall of the heat exchanger to be optionally comprised of two sections which are bolted together by bolts 392; and additionally shows an outer layer of heat and cold insulating material 394, which may be of any suitable composition. Returning to FIG. 14, needle valve 329 is sealed at the lower end by end plug 395 which is threadably received in cylinder 332. Shaft 354 protrudes through plug 395 with "o-rings" provided for seals. Valve cover 396, provided with appertures (not shown) so that the location of the end of shaft 354 can be visually inspected, is threadably received on the end of needle valve 329. Divider plug 397 is threadably received in the upper portion of cylinder 332 with shaft 354 protruding through it, "o-rings" are provided for pressure seals.

Figure 17:
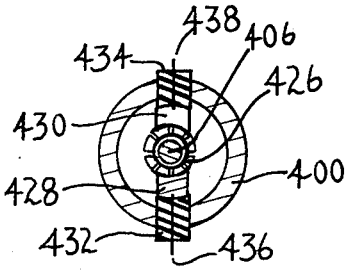
FIG. 17, is a cross section of FIG. 16 at 17—17.
Figures 18, 19, 20:
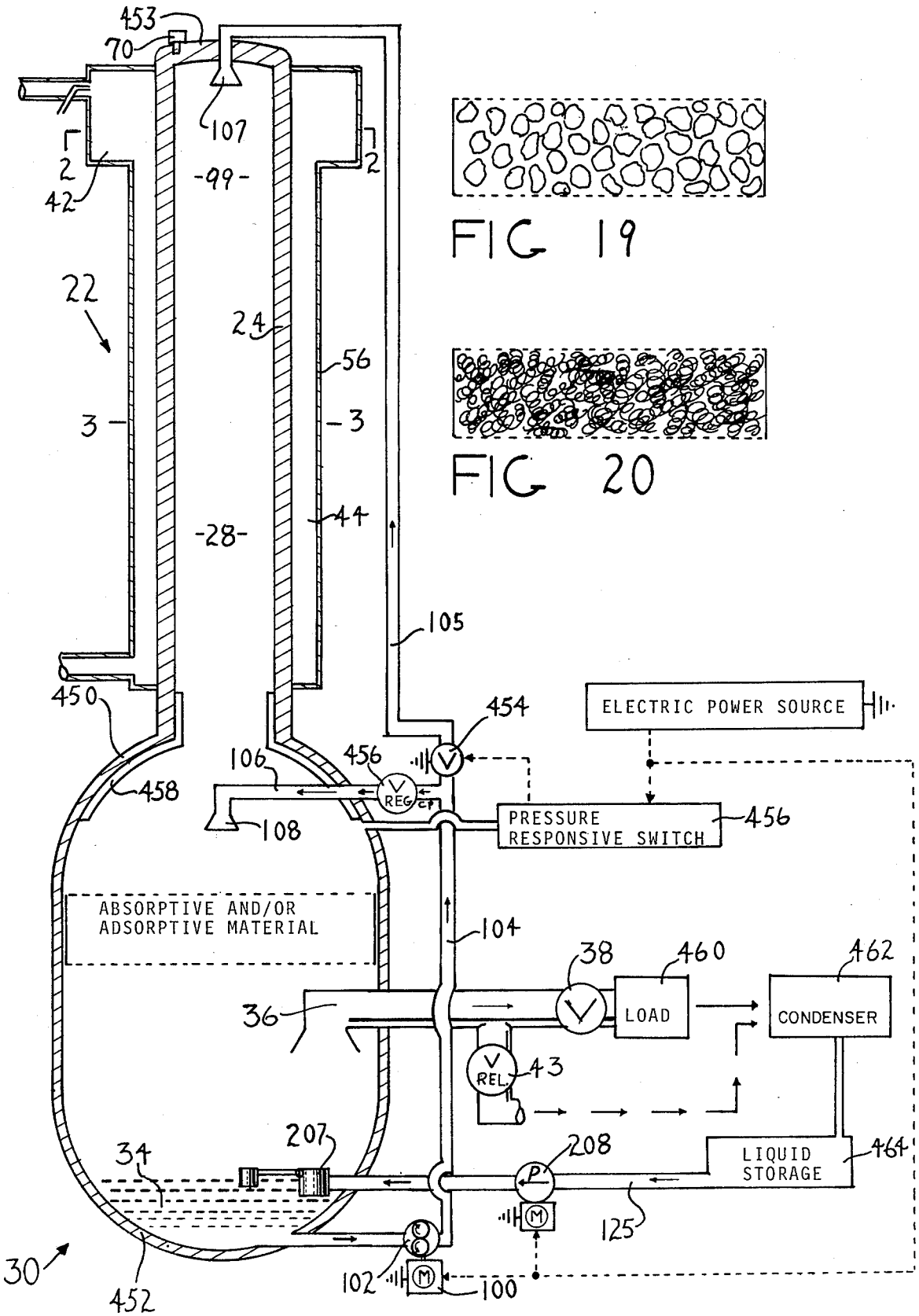
FIG. 18, is a block diagram and diagramatic representation of the apparatus showing the fluid container as having rounded corners, the pressure responsive switch operating a valve for moving fluid to the heat exchanger and showing a condensor for cooling steam and producing liquid to be recycled back into the apparatus.
FIG. 19, shows a cartridge wherein the absorptive and/or adsorptive material is in particle form.
FIG. 20, shows a cartridge wherein the absorptive and/or adsorptive material is in the form of spirals.

Turning to FIG. 17, a pressure responsive switch is shown of the type suitable for the apparatus in FIG. 1 and 19. The pressure switch is comprised of a tubular body 400 which is threadably received in the confining wall of fluid container 30 at 402. Piston 404 and attached shaft 406 with attached end plate 408 are urged outwardly in cylinder 409 defined by tubular body 400, by the pressure of fluid in fluid container 30 which enters cylinder 409. Shaft 406 is electrically insulated from piston 404 and end plate 408 by electricity insulating material 410 and 412 located in piston 404 and end plate 408 respectively as shown. End plate 408 is urged inwardly by spring 414 which presses against turning screw 416, the latter being threadably received in a widened section of the tubular body 400 of the pressure responsive switch at 418. Groove 420 is provided in the turning screw for permitting use of a screwdriver to turn the turning screw inwardly or outwardly for increasing or decreasing the tension of spring 414. Locknut 422 is provided for holding turning screw 416 in the proper adjustment. Shaft 406 is provided with a metallic electricity conducting band 424 with outwardly directed (inwardly arched) fingers 426, the fingers and band conduct electricity from conducting plate 428 to rheostat 430. Plate 428 and rheostat 430 are electrically insulated from body 400 of the switch by insulating material 432 and 434 respectively, and electrically conducting wires 436 and 438 pass through the insulating material 432 and 434 respectively and are electrically coupled wth plate 428 and rheostat 430 respectively. When piston 404 is in an inward position (as results when the pressure in fluid container 30 is low), a greater amount of electricity flows between wire 436 and wire 438. As piston 404 moves inwardly (as occurs when the pressure in container 30 increases) the flow of electricity between wire 436 and wire 438 decreases and finally stops when fingers 426 are no longer in contact with plate 428 and/or rheostat 430. The increase or reduction in electric current flowing between wires 436 and 438 increases or decreases respectively the speed of a variable speed motor as for example variable speed motor 100, FIG. 1, thereby increasing or decreasing respectively the flow of liquid moved to the top end 99 of liquid heating passage 28, FIG. 1.

FIG. 18 shows the rapid response generator with fluid container 30 having rounded top end 450 and rounded bottom end 452, as the rounded geometry is generally well suited for holding pressure. Also, top end 453 of the heat exchanger is shown to be somewhat rounded for the same purpose. The combustion chamber is in the top end of the heat exchanger as in FIGS. 11, 12 and 13, with the flow of exhaust in the exhaust heating passage being the same (vertical) direction as the flow of fluid in the fluid heating passage. Thermostat 70 is in the same end of the heat exchanger as the combustion chamber.

Figure 16:
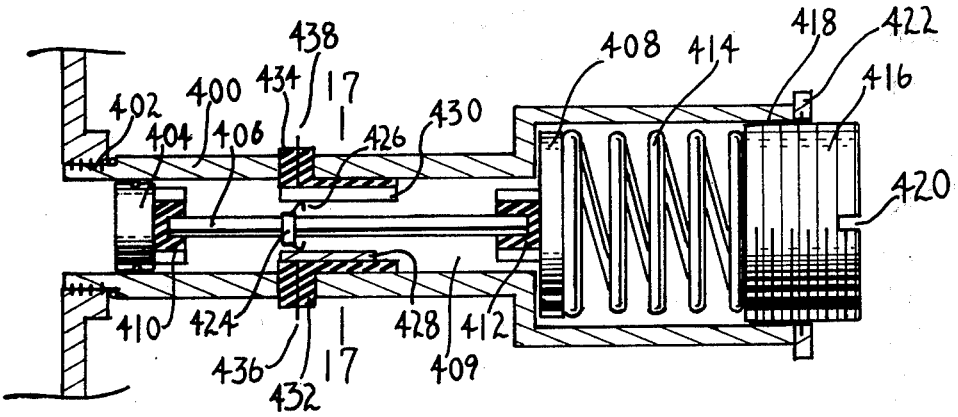
FIG. 16, is an example of a pressure responsive switch of the type which may be used with the apparatuses shown in FIGS. 1 and 18.

In FIG. 18 the pressure responsive switch 456, which may be of the type shown in FIG. 16, allows the flow of current from the electric power source to electrically operated valve 454 so that the volume flow of liquid through valve 454 increases as pressure within fluid container 30 decreases and vice versa. The flow of fluid through valve 454 is terminated when the pressure within fluid container 30 reaches a predetermined pressure.

Pump 102, powered by motor 100, FIG. 18, operates continuously when the apparatus is functioning. Constant pressure inlet valve 456 retains a constant pressure in tube 104.

Heat and cold insulating material 458, FIG. 18, covers the interior of rounded top end 450 of fluid storage container 30 and also extends into the lower portion of the fluid heating passage 28 for preventing direct heating of the contents of the fluid storage container 30 by heat retaining substance 24. Heat and cold insulating material which typically covers the outer surface of the apparatus is not shown in this figure.

The volume flow of steam flowing through steam discharge passage 36 to load 460 (which may be any suitable steam operated device such as for example the pistons of a pressure motor) is controlled by valve 38. Steam which has passed through load 460 (and steam, if any, which has passed through pressure relief valve 43) flows to condenser 462 wherein the steam is condensed to form replacement liquid which is stored in the liquid storage tank 464, from where it is pumped through passage 125 via pump 208 and back into fluid reservoir 34 in fluid container 30.

The absorptive and/or adsorptive particulate matter shown in FIG. 19 may be comprised of any suitable material as for example material of ceramic composition which may or may not be porous in consistency and the surface may or may not have irregularities wherein liquid is retained. The particles shown in FIG. 19 are of irregular globular shape.

The absorptive and/or adsorptive material shown in FIG. 20 is in the form of coils or "spring-shaped" material in which may be of any suitable composition as for example stainless steel or fiberglas.

Ceramic composition material may optionally be used wherever heat and cold insulating or electrical insulation is shown, or any suitable heat and cold insulating material may be used.

The apparatus shown in each of the figures has features, any of which if suitable may be used in any of the apparatuses shown. The combustion chamber may be located at either end of the heat exchanger or at any location in the heat exchanger, or may be located away from the heat exchanger with hot exhaust from the combustion chamber communicated to the heat exchanger for heating purposes; and a combustion chamber of any suitable geometry may be used although I prefer the annular combustion chamber. The exhaust in the heat transfer tube may flow in the same direction or in the opposite direction as flow of fluid in the fluid heating passage.

Fluid may be moved from the fluid storage container to the fluid heating passage through a tube on the outside of the apparatus or through a tube within the apparatus. The fluid inlet of the fluid heating passage may comprise a spray head for liquid or a valve for gas (or gas and liquid droplets). FIG. 12 shows the valve at the upper end of tubular member 174, however, the valve may be at or near the lower end of the tubular member.

A solid fuel particle reducer may or may not be used with the apparatus, and if needed, any suitable type may be used.

Various additional modifications and extensions of this invention will become apparent to those skilled in the art. All such variations and deviations which basically rely on the teachings through which this invention has advanced the art are properly considered to be within the spirit and scope of the invention.

What is claimed:

1. A rapid response steam generator comprising:

(a) a combustion chamber having fuel and oxygen intake passage means, fuel ignition means, and an exhaust discharge outlet, for burning fuel and generating heat energy;

(b) a fluid storage container for storing steam and liquid under pressure;

(c) a heat exchanger mounted on and located above the fluid storage container, the heat exchanger having a heat retaining substance, a fluid inlet, a fluid outlet communicating with the fluid storage container, and a fluid heating passage communicating with the fluid inlet and fluid outlet wherein heat is transferred from the heat retaining substance to fluid within the fluid heating passage;

(d) means for transferring heat energy generated in the combustion chamber to the heat retaining substance in the heat exchanger;

(e) means for commencing the burning of fuel for the generation of heat energy in the combustion chamber when temperature at a given location of the heat retaining substance is below a predetermined temperature and terminating the burning of fuel when the temperature of the heat retaining substance has reached a predetermined temperature;

(f) means for moving liquid from the fluid storage container through the fluid inlet of the heat exchanger and into the fluid heating passage for the generation of steam when the pressure within the apparatus is below a predetermined pressure and terminating the movement of the liquid when the pressure within the apparatus is above a predetermined pressure;

(g) means for discharging steam under pressure from the fluid storage container as available steam pressure for operating a load;

(h) means for moving liquid into the apparatus for replacing liquid which has been used by the apparatus for the generating of steam.

2. A rapid response steam generator, comprising:

(a) a combustion chamber having fuel and oxygen intake passage means, fuel ignition means, and an exhaust discharge outlet, for burning fuel and generating heat energy;

(b) a fluid storage container for storing steam and liquid under pressure;

(c) a heat exchanger mounted on and located above the fluid storage container, the heat exchanger having a heat retaining substance, a fluid inlet, a fluid outlet commencing with the fluid storage container, and a fluid heating passage communicating with the fluid inlet and fluid outlet wherein heat is transferred from the heat retaining substance to fluid within the fluid heating passage for the production of superheated gas;

(d) means for transferring heat energy generated in the combustion chamber to the heat retaining substance in the heat exchanger;

(e) means for commencing the burning of fuel for the generating of heat energy by the fuel burning means when the temperature at a given location of the heat retaining substance is below a predetermined temperature and terminating the burning of fuel when the temperature of the heat retaining substance has reached a predetermined temperature;

(f) means for moving fluid from the fluid storage container through the fluid inlet of the heat exchanger and into the fluid heating passage for the production of superheated gas when pressure within the apparatus is below a predetermined pressure and terminating the movement of the fluid when the pressure within the apparatus is above a predetermined pressure;

(g) means for moving the superheated gas produced in the fluid heating passage into contact with liquid in the fluid storage container for the generation of steam;

(h) means for discharging steam under pressure from the fluid storage container as available steam pressure for operating a load;

(i) means for moving liquid into the apparatus for replacing liquid which has been used by the apparatus for generating steam.

3. The rapid response steam generator as recited in claim 1 or 2, further comprising:

means for providing the heat retaining substance with a relatively large surface area for receiving heat energy within a relatively small heat exchanger.

4. The rapid response steam generator as recited in claim 1, further comprising:

means for providing the heat retaining substance with a relatively large area of contact of liquid with the heat retaining substance within a relatively small heat exchanger.

5. The rapid response steam generator as recited in claim 2, further comprising:

means for providing a heat retaining substance with relatively large area of contact of fluid with the heat retaining substance within a relatively small heat exchanger.

6. The rapid response steam generator as described in claim 1 or 2, wherein:

the combustion chamber is an annular combustion chamber and the fuel and oxygen intake means comprises at least one eccentric passage for causing the fuel and oxygen to arc and burn in the peripheral annular portion of the combustion chamber.

7. The rapid response steam generator as described in claim 1 or 2, further comprising:

means for injecting concentrated oxygen and a mixture of concentrated nitrogen and solid fuel particles into the combustion chamber and means for adjusting the ratio of concentrated oxygen and concentrated nitrogen, and the ratio of concentrated oxygen and solid fuel particles injected into the combustion chamber.

8. The rapid response steam generator as described in claim 1 or 2, further comprising:

means for injecting air and a mixture of air and solid fuel particles into the combustion chamber, and means for adjusting the ratio of air and solid fuel particles injected into the combustion chamber.

9. The rapid response steam generator as described in claim 1 or 2, further comprising:

means for injecting fuel, and selecting the fuel to be injected from liquid fuel, gaseous fuel, and solid fuel particles mixed with a gaseous substance.

10. The rapid response steam generator as recited in claim 1 or 2, wherein the means for moving liquid into the apparatus for replacing liquid which has been used by the apparatus for the generation of steam comprises:

means for retaining the liquid at a predetermined level in the lower portion of the fluid storage container.

11. The rapid response steam generator as recited in claim 1 or 2, wherein the means for moving liquid into the apparatus for replacing liquid which has been used by the apparatus for the generation of steam comprises means for condensing steam for the production of replacement liquid.

12. The rapid response steam generator as recited in claim 1 or 2, wherein:

the heat exchanger is mounted above, and secured to the fluid storage container.

13. A method for the rapid generation of steam comprising the following steps:

(a) burning fuel for the generation of heat energy;

(b) transferring the heat energy generated by the burning of fuel to a heat retaining substance in a heat exchanger;

(c) commencing and terminating the burning of fuel by temperature responsive means for maintaining the temperature of a given location in the heat retaining substance at essentially a predetermined temperature;

(d) storing steam and liquid under pressure in a fluid storage container mounted onto and located under the heat exchanger;

(e) moving liquid from the fluid storage container into contact with the heat retaining substance in the heat exchanger for heating the liquid for the generation of steam;

(f) moving the steam produced within the heat exchanger to the fluid storage container;

(g) commencing and terminating the movement of liquid from the fluid storage container into contact with the heat retaining substance in the heat exchanger by pressure responsive means for maintaining the pressure within the apparatus at essentially a predetermined pressure;

(h) discharging steam stored in the fluid storage container as available steam for operating a load;

(i) moving liquid into the apparatus for replacing liquid used by the apparatus in the generation of steam.

14. A method for the rapid generation of steam comprising the following steps:

(a) burning fuel for the generation of heat energy;

(b) transferring the heat energy generated by the burning of fuel to a heat retaining substance in a heat exchanger;

(c) commencing and terminating the burning of fuel by temperature responsive means for maintaining the temperature of a give location in the heat retaining substance at essentially a predetermined temperature;

(d) storing steam and liquid under pressure in a fluid storage container mounted onto and located under the heat exchanger;

(e) moving fluid from the fluid storage container into contact with the heat retaining substance in the heat exchanger for heating the fluid and the production of superheated gas;

(f) moving the superheated gas into contact with liquid within the fluid storage container for the generation of steam;

(g) commencing and terminating the movement of fluid from the fluid storage container into contact with the heat retaining substance in the heat exchanger by pressure responsive means for retaining the pressure within the apparatus at essentially a predetermined pressure;

(h) discharging steam within the fluid storage container as available steam pressure for operating a load;

(i) moving liquid into the apparatus for replacing liquid used by the apparatus for the generation of steam.

15. The method for the rapid generation of steam as defined in claim 14, wherein the step of moving the superheated gas into contact with liquid within the fluid storage container for the generation of steam comprises passing the superheated gas through an absorptive material which has been saturated with liquid.

16. The method for the rapid generation of steam as defined in claim 14, wherein: the step of moving the superheated gas into contact with liquid within the fluid storage container for the generation of steam comprises passing the superheated gas through an adsorptive material which has been saturated with liquid.

17. The method for the rapid generation of steam as defined in claim 13 or 14, further comprising the step of:

replacing the liquid used for the generation of steam.

18. The method for the rapid generation of steam as defined in claim 13 or 14, wherein the step of burning fuel for the generation of heat energy comprises:

burning fuel particles mixed with a gaseous substance.

19. The method for the rapid generation of steam as defined in claim 13 or 14, wherein the step of burning fuel for the generation of heat energy comprises:

burning a mixture of fuel particles and concentrated nitrogen with concentrated oxygen.

20. The method for the rapid generation of steam as defined in claim 13 or 14, wherein the step of transferring the heat energy generated by the burning of fuel to a heat retaining substance comprises providing a relatively large surface area of heat retaining substance for receiving heat within a relatively small heat exchanger.

21. The method for the rapid generation of steam as defined in claim 13, wherein the step of moving liquid from the fluid storage container into contact with a heat retaining substance for the generation of steam comprises: providing the heat retaining substance with a relatively large area of exposure to liquid within a relatively small heat exchanger.

22. The method for the rapid generation of steam as defined in claim 14, wherein the step of moving fluid from the fluid storage container into contact with a heat retaining substance for the generation of superheated gas comprises:

providing the heat retaining substance with a relatively large surface area for contact with fluid within a relatively small heat exchanger.

* * * * *

UNITED STATES PATENT AND TRADEMARK OFFICE

CERTIFICATE OF CORRECTION

PATENT NO. : 4,278,050

DATED : July 14, 1971

INVENTOR(S) : Wellelsley R. Klime

It is certified that error appears in the above—identified patent and that said Letters Patent is hereby corrected as shown below:

The term of this patent subsequent to February 24, 1998, has been disclaimed.

Signed and Sealed this

*Twenty-ninth* Day of *December 1981*

[SEAL]

*Attest:*

GERALD J. MOSSINGHOFF

*Attesting Officer*

*Commissioner of Patents and Trademarks*